US005462460A

United States Patent [19]

Kobaysahi

[11] Patent Number: 5,462,460

[45] Date of Patent: Oct. 31, 1995

[54] JET PROPULSION UNIT AND PRIME MOVER THEREFORE

[75] Inventor: Noboru Kobaysahi, Shizuoka, Japan

[73] Assignee: Yamaha Hatsudoki Kabushiki Kaisha, Iwata, Japan

[21] Appl. No.: 224,829

[22] Filed: Apr. 8, 1994

[30] Foreign Application Priority Data

Apr. 8, 1993 [JP] Japan ..... 5-082133

[51] Int. Cl.[6] ..... B60L 11/02

[52] U.S. Cl. ..... 440/6; 440/38

[58] Field of Search ..... 440/6, 7, 38; 60/221, 60/222; 114/345

[56] References Cited

U.S. PATENT DOCUMENTS 3,002,486 10/1961 Jardmo ..... 440/38

5,131,348 7/1992 Roy ..... 114/345

5,140,926 8/1992 Denston ..... 440/6

5,185,545 2/1993 Veronesi et al. ..... 440/38

5,376,027 12/1994 Hergenrather .

*Primary Examiner*—Stephen Avila

*Attorney, Agent, or Firm*—Knobbe, Martens, Olson & Bear

[57] ABSTRACT

A pair of small watercraft powered by a combined jet propulsion and prime mover unit so as to eliminate the use of separate impeller drive shafts passing through the water inlet duct. The prime mover may comprise either an electric motor or an internal combustion engine and is supported within a nacelle to the rear of the impeller.

14 Claims, 8 Drawing Sheets

JET PROPULSION UNIT AND PRIME MOVER THEREFORE

BACKGROUND OF THE INVENTION

This invention relates to a jet propulsion and prime mover unit and particularly to an improved propulsion unit for watercraft.

A particularly popular propulsion device for watercraft is the so-called "water jet propulsion unit." These types of devices include an outer housing that defines a water inlet duct through which water is drawn from the body of water in which the watercraft operates by means of an impeller mounted in an impeller housing to the rear of the water inlet duct. The water pumped by the impeller is then discharged through a rearwardly facing discharge nozzle for generating a propulsion force for the watercraft. Normally, this type of device is propelled by a prime mover that is positioned in the hull forwardly of the jet propulsion unit and which drives an impeller shaft that extends through the water inlet duct for driving the impeller.

FIG. 1 is a view that shows a conventional type of drive of this type and illustrates several of the disadvantages of it. In FIG. 1, the watercraft hull is shown partially and is comprised of an under or lower hull portion 21, above which a jet propulsion unit, indicated generally by the reference numeral 23, is supported. Forwardly in the hull from the jet propulsion unit 22, a prime mover such as an internal combustion engine 23 is supported.

The jet propulsion unit 22 includes an outer housing assembly, indicated generally by the reference numeral 24, which includes a housing portion 25 that defines a downwardly facing opening 26 that registers with a corresponding opening 27 in the hull portion 21. A duct 28 extends from this inlet opening to a portion of the housing assembly 24 in which an impeller 29 is supported for rotation. The impeller 29 is generally supported at its aft end by a combined nacelle and straightening vane portion 31. Water pumped past this portion is then discharged through a discharge nozzle 32, which faces rearwardly for generating a propulsion force to the watercraft. Frequently a steering nozzle (not shown) is supported on the discharge nozzle 32 and is pivotal about a vertically extending axis for steering of the watercraft.

In order to drive the impeller 29 from the forwardly positioned engine 23, there is provided an impeller shaft 33, which is coupled suitably to the engine output shaft 34 and which drives the impeller 29. Frequently the outer housing, and particularly the water inlet portion 25, is provided with a forwardly projecting pilot portion 35 that contains seals 36 and bearings 37 for journaling the forward end of the impeller shaft.

With this prior art type of construction, a number of problems arise. First, since the impeller shaft 33 extends through the water inlet duct 28, foreign material, indicated at 38, can easily collect on the impeller shaft 33. This foreign material can be seaweed, foreign objects, and the like. This accumulation of material not only impairs the efficiency of the jet propulsion unit but can, in extreme cases, clog it.

In addition to this defect, the forward positioning of the prime mover 23 and the use of the long engine output shaft 34 and impeller shaft 33 requires either universal joints or some type of coupling so as to accommodate axial and angular misalignments and also require very accurate positioning of the jet propulsion unit 22 and prime mover 23.

It is therefore a principal object of this invention to provide an improved jet propulsion and prime mover unit for powering a watercraft.

It is a further object of this invention to provide a jet propulsion and prime mover unit wherein the impeller of the jet propulsion unit can be driven without the necessity of shafts extending externally of the jet propulsion unit.

It is a further object of this invention to provide an improved jet propulsion and prime mover unit wherein the impeller of the jet propulsion unit can be driven by a prime mover without any drive shaft extending through the water inlet of the jet propulsion unit.

In addition to the defects aforenoted, the fact that the impeller shaft extends through the water inlet duct and since foreign materials can become entangled on the shaft, the effective cross-sectional flow area of the water inlet duct is reduced. Although this can be compensated for by increasing the size of the outer housing, this adds considerable difficulties to the desired positioning of the jet propulsion unit and adds to its bulk, which is undesirable.

It is therefore a still further object of this invention to provide an improved jet propulsion and prime mover unit for a watercraft wherein the impeller drive shaft does not extend through the water inlet duct.

SUMMARY OF THE INVENTION

A first feature of this invention is adapted to be embodied in a jet propulsion and prime mover unit comprised of an outer housing assembly defining a water inlet opening through which water may be drawn from a body of water and a water inlet duct leading from the water inlet opening to an impeller housing. An impeller is journalled within the impeller housing for drawing water from the water inlet duct. The outer housing of the unit further defines a discharge duct, which leads from the impeller housing for discharging water pumped by the impeller back to the body of water and propelling an associated watercraft. A prime mover is contained within the outer housing and is coupled to the impeller for driving the impeller.

Another feature of the invention is adapted also to be embodied in a jet propulsion unit and a prime mover. The jet propulsion unit comprises an outer housing assembly defining a water inlet opening through which water may be drawn from a body of water, a water inlet duct leading from the water inlet opening to an impeller housing, and a discharge duct leading from the impeller housing for discharging water back to the body of water in which the watercraft is operating. An impeller is journalled within the impeller housing, and a prime mover is disposed rearwardly of the impeller and is coupled to the impeller for driving it, so that the drive for the impeller does not extend through the water inlet duct.

Figure 3:
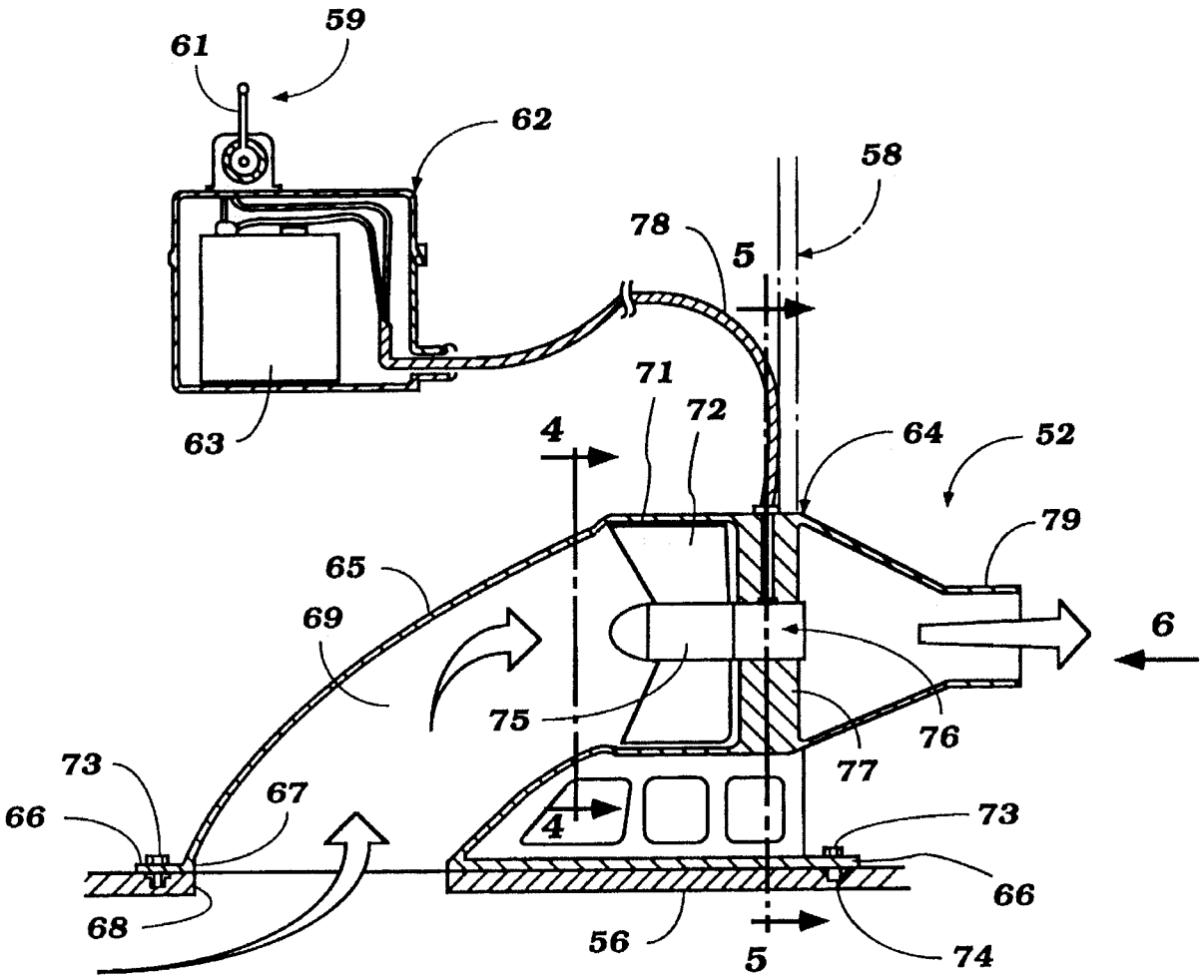
FIG. 3 is an enlarged cross-sectional view taken through the jet propulsion unit and shows the control for the prime mover in a partially schematic and moved position, so as to show the interrelationship.
Figure 4:
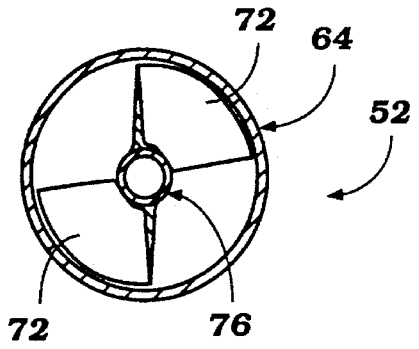
FIG. 4 is a cross-sectional view taken along the line 4—4 of FIG. 3.
Figure 5:
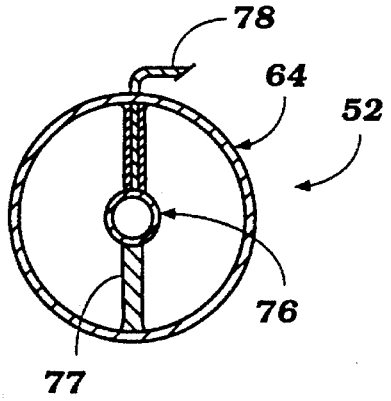

FIG. 5 is a cross-sectional view taken along the line 5—5 of FIG. 3.

Figure 6:
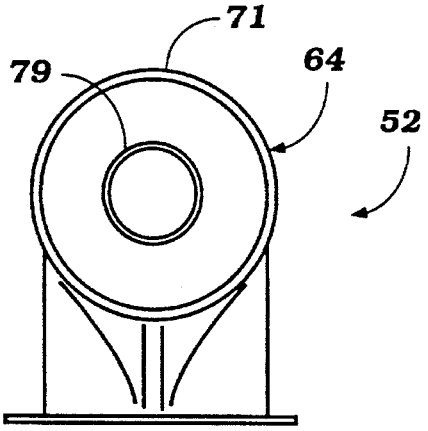

FIG. 6 is a rear elevational view looking in the direction of the arrow 6 in FIG. 3.

Figure 7:
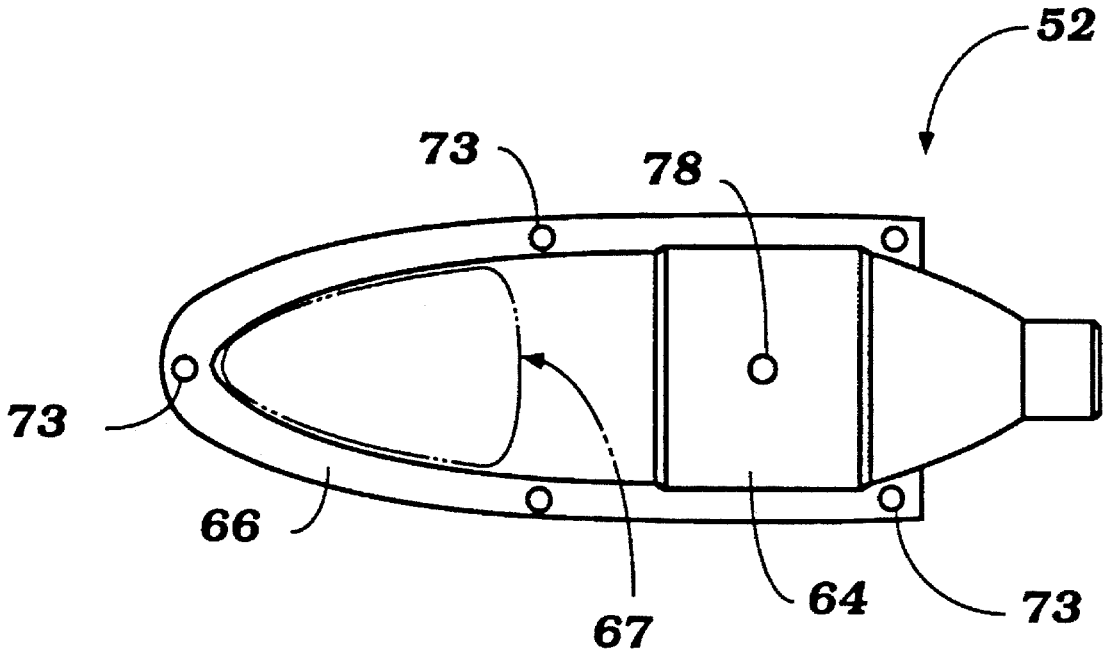

FIG. 7 is a top plan view of the unit.

Figure 8:
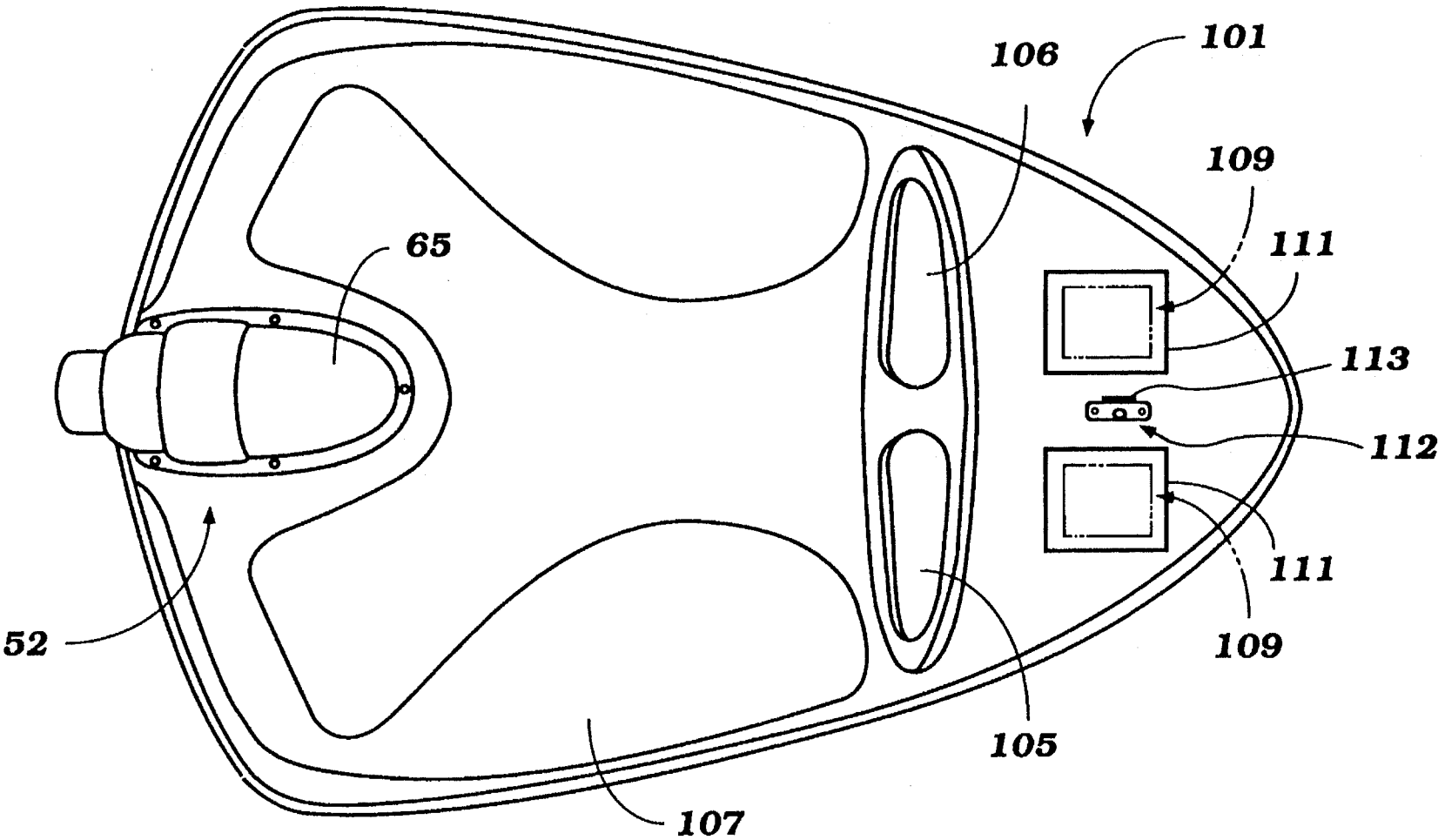

FIG. 8 is a top plan view of a watercraft constructed in accordance with another embodiment of the invention and powered by a combined jet propulsion/prime mover unit constructed in accordance with the embodiment, as previously described.

Figure 9:
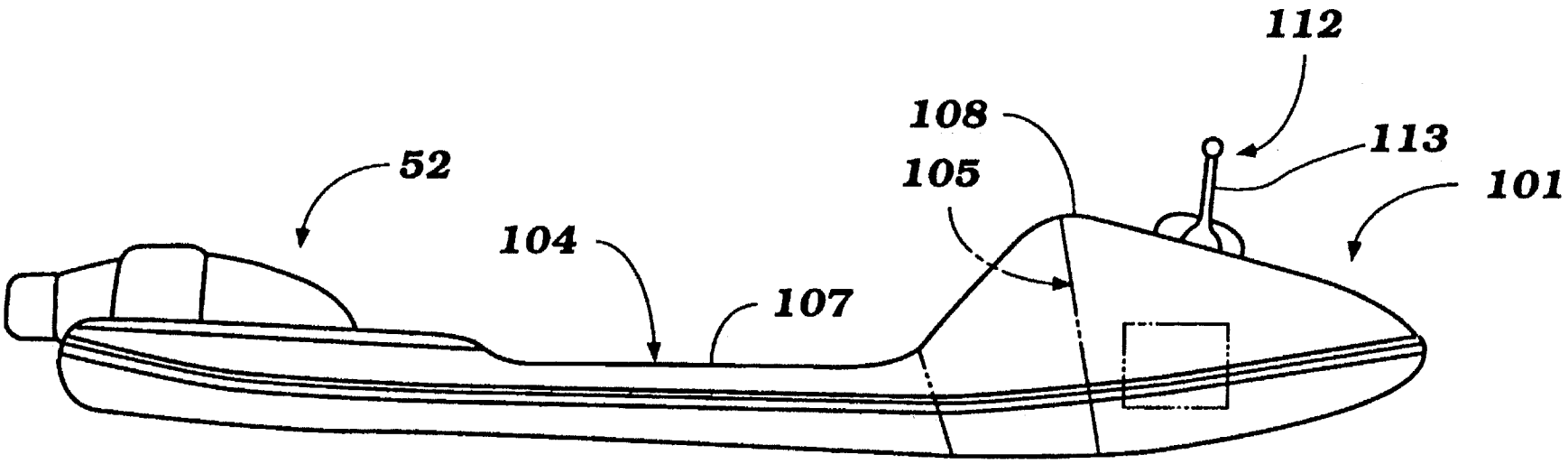

FIG. 9 is a side elevational view of the watercraft of FIG. 8.

Figure 10:
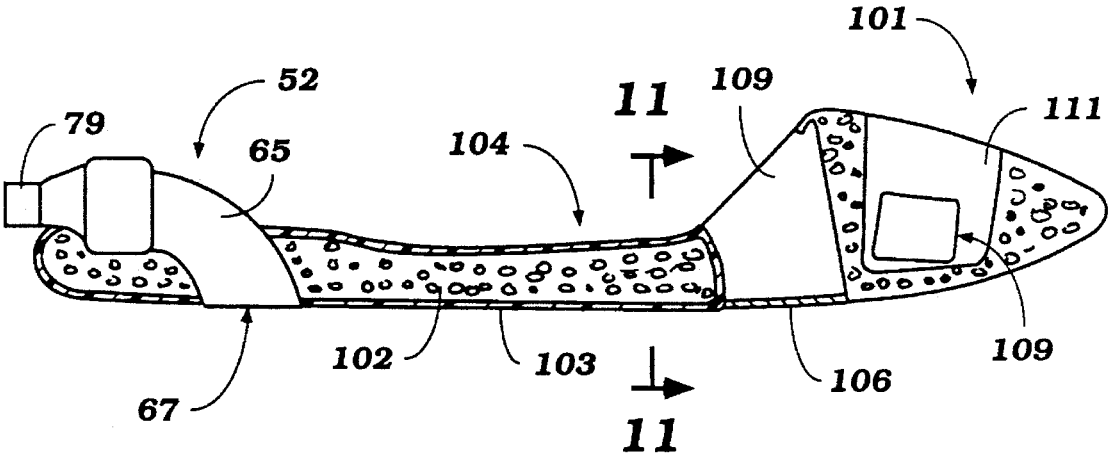

FIG. 10 is a longitudinal cross-sectional view taken through the hull of this embodiment but showing the jet propulsion/prime mover unit in elevation.

Figure 11:
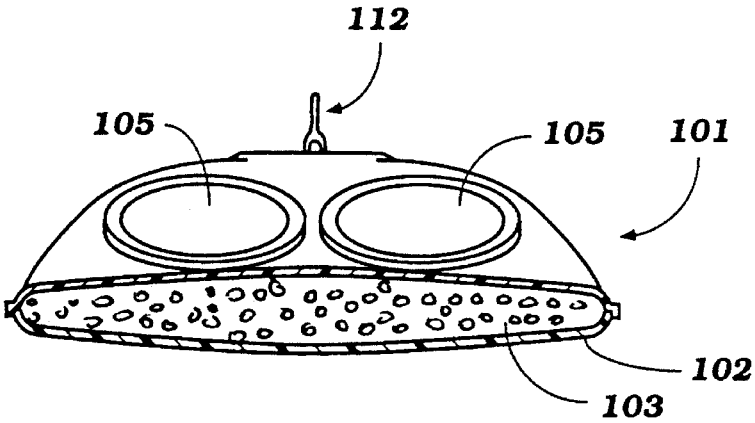

FIG. 11 is a cross-sectional view taken along the line 11—11 of FIG. 10.

DETAILED DESCRIPTION OF THE PREFERRED EMBODIMENTS OF THE INVENTION

Figure 1:
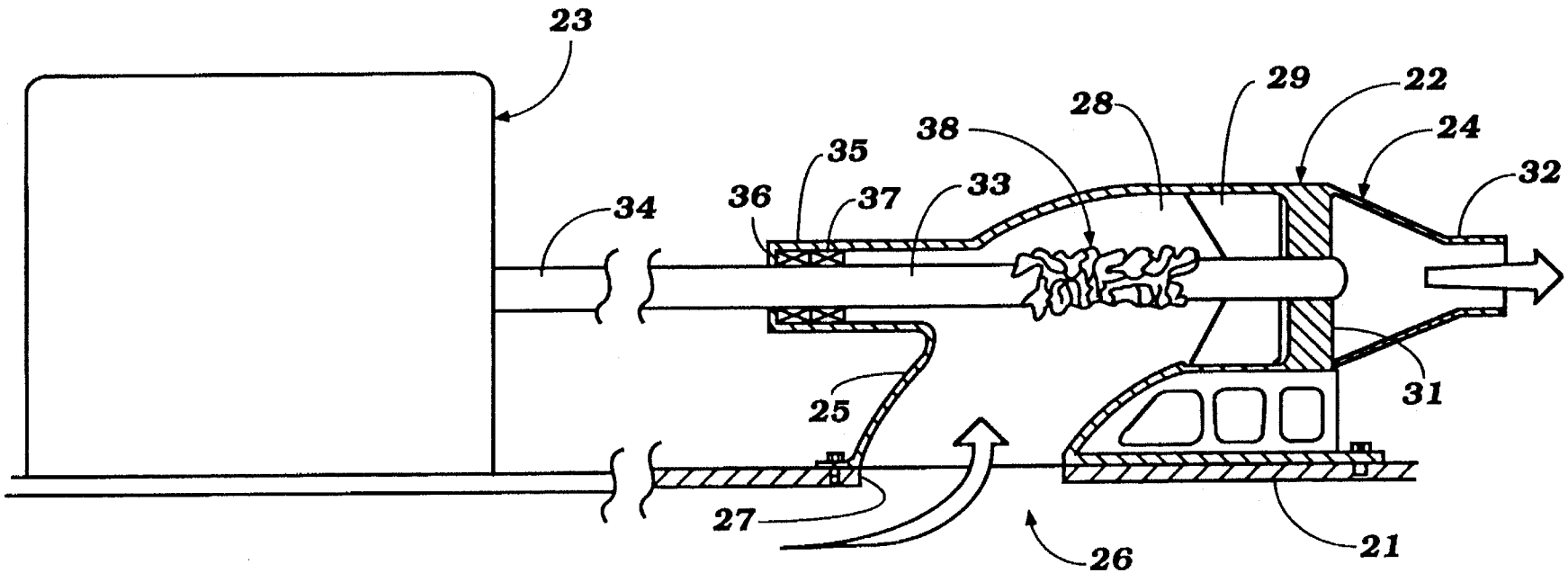
Figure 1 Prior art
FIG. 1 is a partial side elevational view, with a portion shown in section, of a jet propulsion unit and prime mover constructed in accordance with the prior art type of constructions.
Figure 2:
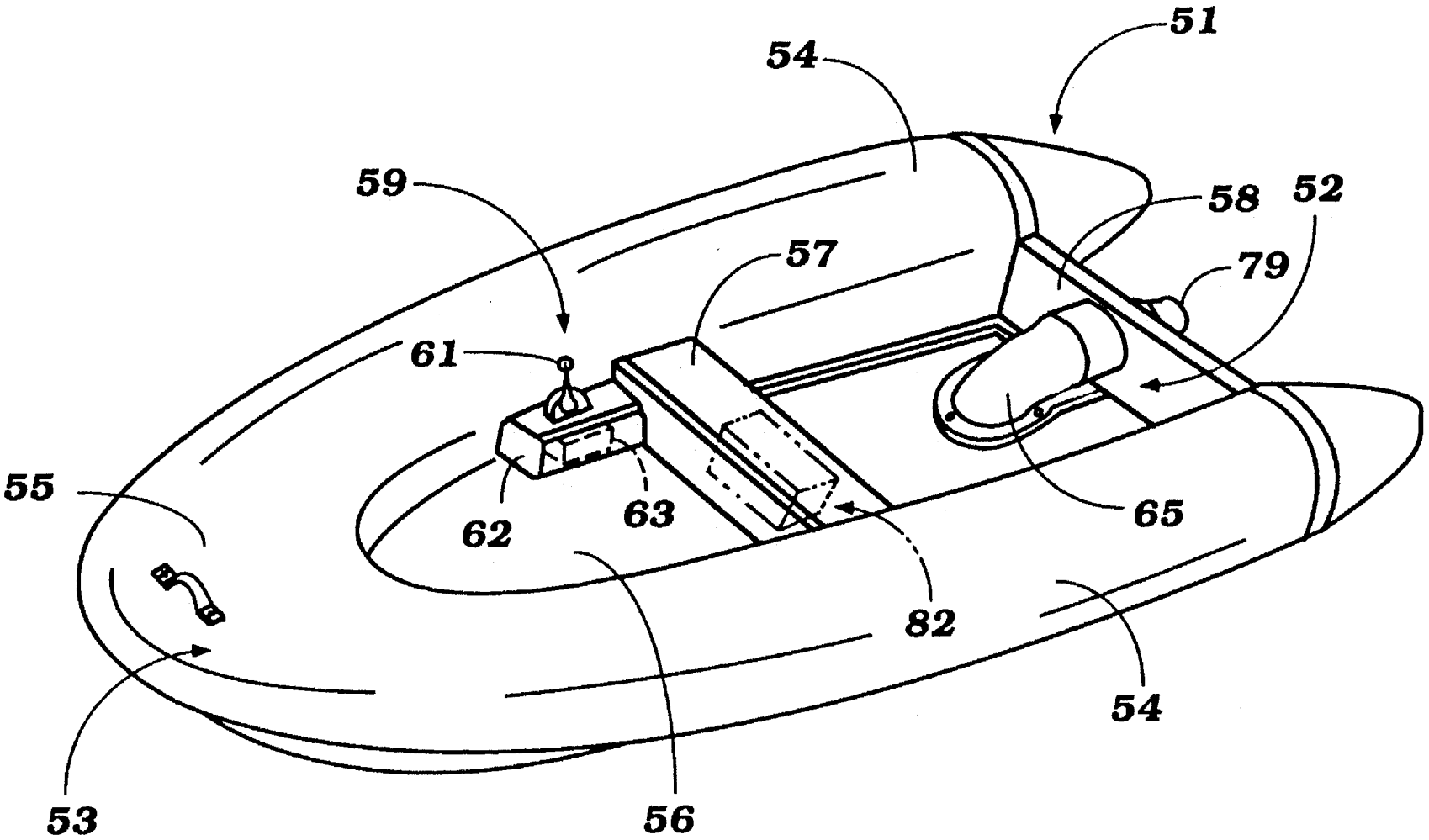
FIG. 2 is a perspective view of a watercraft powered by a jet propulsion and prime mover unit embodying the invention.

Referring first to the embodiment of FIGS. 2–7, and initially primarily to FIG. 2, a watercraft powered by a combined jet propulsion/prime mover unit constructed in accordance with an embodiment of the invention is identified generally by the reference numeral 51. The watercraft 51 illustrated is one of many types of watercraft that may be powered by a combined jet propulsion/prime mover unit constructed in accordance with an embodiment of the invention and which unit is identified generally by the reference numeral 52. Therefore, the configuration of the watercraft 51 is to be considered as exemplary only, although this particular type of watercraft lends itself very aptly to propulsion by the unit 52.

The watercraft 51 is comprised of a hull, indicated generally at 53, that has a pair of generally tubular side portions 54, which are connected integrally at their front end by a reentrant section 55. This portion of the hull 53 may be formed from an elastic, inflatable material. A floor 56 spans the hull sections of 54 and 55 and provides a single bench-type seat 57 that extends transversely across a passenger's area. The rear portion of the passenger's area is enclosed by a transom 58, which extends between the rear sides of the hull portions 54.

A control, indicated generally by the reference numeral 59, is mounted on the floor 56 at one side of the seat 57. This control 59 includes a control lever 61, which is supported on a base 62 and which contains a battery 63 for powering the prime mover of the jet propulsion/prime mover unit 52, as will become apparent by reference to the remaining figures of this embodiment (FIGS. 3–7).

The jet propulsion/prime mover unit 52 is comprised of an outer housing assembly, indicated generally by the reference numeral 64 and which may be comprised either of a unitary assembly or a number of interconnected pieces, as will be readily apparent to those skilled in the art. The outer housing assembly 64 includes a water inlet duct-forming portion 65 that terminates in a downwardly extending flange 66 that defines a water inlet opening 67, which is aligned with a corresponding opening 68 formed in the hull floor 56 so that water can enter the water inlet duct-forming portion 65. A water inlet duct 69 extends from the opening 67 to an impeller portion 71, in which an impeller 72 is journalled, in a manner to be described.

The flange 66 of the housing portion 65 is affixed by means of a plurality of threaded fasteners 73 to the hull floor 56. A seal 74 is interposed between the flange 66 and the upper side of the floor 56 so as to provide a watertight assembly.

The impeller 72 has a hub portion 75, which is drivingly connected to the output shaft of an electric motor, indicated generally by the reference numeral 76. The electric motor 76 is mounted centrally within a nacelle formed at the interperiphery of a pair of straightening vanes 77 and to the rear of the impeller 72. The electric motor 76 is provided with a pair of power supply cables 78 that extend up through the housing 64 and forwardly to the battery 63, through a rheostat control operated by the lever 61. As a result, the speed of the motor 76 may be varied by changing the position of the lever 61.

Water that is pumped by the impeller 72 will be driven rearwardly past the straightening vanes 77 into a discharge nozzle 79, which extends through the transom plate 58 and through which water is discharged, as shown by the arrow in FIG. 3, for propelling the watercraft. If desired, a steering nozzle (not shown) may be pivotally supported at the discharge end of the discharge nozzle 79 about a vertically extending steering axis for steering of the watercraft. This steering nozzle may be controlled in any suitable manner. Alternatively to employing the electric motor 76 as the prime mover, a small internal combustion engine may be mounted in the nacelle and straightening vane portion 77 and coupled to the impeller hub 75 either by a gear box or directly. In this instance a fuel tank 82 may be provided beneath the seat 57 for providing fuel to the engine for its operation. Alternatively, and if battery power is employed, the device 82 may be an auxiliary battery.

A watercraft of another type, which may be propelled by a jet propulsion and prime mover unit of the type already described, is shown in FIGS. 9–11 and is identified generally by the reference numeral 101. Again, the watercraft 101 is only one of many types that can be propelled by a unit, as described herein. However, the configuration of the watercraft 51 and 101 lend themselves to the use of this type of jet propulsion and prime mover unit because of its very compact nature.

Referring specifically to this embodiment, the watercraft 101 is formed of a hull that is comprised of a foam core 101 that is surrounded by a protective skin 103 to form a hull, indicated generally by the reference numeral 104. Obviously, the hull can be formed in other manners than that described, but this construction lends itself to a very lightweight, easily portable watercraft, which can be relatively low in cost and which has high buoyancy. The hull 104 has a generally open deck area with a pair of portholes 105 formed forwardly thereof and which have a transparent window 106 at the lower end so that riders can view the underwater terrain through the portholes 105. The riders may either sit or lie on a deck 107 formed to the rear of a raised forward portion 108 in which the portholes 105 are formed.

This raised area affords a pair of forward compartments in which a pair of batteries 109 or fuel tanks depending on the prime mover may be positioned and which are accessible through hatch covers 111.

The jet propulsion/prime mover unit, indicated generally by the reference numeral 52, is mounted at the rear of the hull 104, and its downwardly facing water inlet opening 67 opens through the under skin 103 of the hull so as to permit water to be drawn from the body of water in which the watercraft is operating. As with the previously described embodiment, the jet propulsion/prime mover unit 52 may be powered either by an electrical motor or by an internal combustion engine.

A control assembly 112 is disposed on the raised area 108 of the hull forwardly of the portholes 105 and has a control lever 113, which can control either a rheostat, if the motor is electrically controlled, or the throttle of an internal combustion engine.

It should be readily apparent from the foregoing description that the described embodiments provide a relatively compact watercraft, which can be conveniently powered by a combined jet propulsion and prime mover unit constructed in accordance with the invention. Of course, the foregoing description is that of preferred embodiments of the invention, and various changes and modifications may be made without departing from the spirit and scope of the invention, as defined by the appended claims.

I claim:

1. A jet propulsion and prime mover unit comprised of an outer housing assembly defining a water inlet opening through which water may be drawn from a body of water, a water inlet duct leading from said water inlet opening in a generally upward direction to an impeller housing, an impeller journalled within said impeller housing for drawing water from said water inlet duct, a discharge duct disposed vertically above said water inlet opening and leading from said impeller housing for discharging water pumped by said impeller back to the body of water under all operational conditions and propelling an associated watercraft, sand a prime mover contained within said outer housing between said impeller and aid discharge duct and coupled to said impeller for driving said impeller.

2. A jet propulsion and prime mover unit as in claim 1, wherein the coupling between the prime mover and the impeller does not extend into the water inlet duct.

3. A jet propulsion and prime mover unit as in claim 2, wherein the coupling between the prime mover and the impeller is disposed to the rear of the impeller.

4. A jet propulsion and prime mover unit as in claim 3, wherein the prime mover and impeller are supported by a nacelle disposed to the rear of the impeller.

5. A jet propulsion and prime mover unit as in claim 4, wherein the nacelle is supported within the outer housing by at least a pair of straightening vanes disposed downstream of the impeller.

6. A jet propulsion and prime mover unit as in claim 5, wherein the prime mover comprises an electric motor.

7. A jet propulsion and prime mover unit as in claim 5, wherein the prime mover comprises an internal combustion engine.

8. A jet propulsion and prime mover unit as in claim 1, wherein the prime mover is disposed adjacent the impeller.

9. A jet propulsion and prime mover unit as in claim 8, wherein the prime mover and the impeller are supported by the same portion of the outer housing.

10. A jet propulsion and prime mover unit as set forth in claim 1, wherein the impeller is journalled within the impeller housing for rotation about a longitudinally extending axis and wherein the water inlet duct extends from said axis and curves downwardly to the water inlet opening so that the water inlet opening is disposed transversely to a rotational plane defined by the impeller.

11. A jet propulsion and prime mover unit as set forth in claim 10 in combination with a watercraft having a hull having an undersurface and wherein the water inlet opening is positioned in registry with an opening in the hull undersurface for providing the sole propulsion force for the watercraft.

12. A jet propulsion and prime mover unit as set forth in claim 11, wherein the hull is provided with means spaced from the jet propulsion and prime mover unit for supplying a propulsion source to the prime mover unit for operating the prime mover unit.

13. A jet propulsion and prime mover unit as set forth in claim 12, wherein the prime mover unit comprises an electrical motor and the source comprises a battery.

14. A jet propulsion and prime mover unit as set forth in claim 12, wherein the prime mover unit comprises an internal combustion engine and the source comprises a liquid fuel for the engine.

* * * * *